United States Patent [19]

Baldassarre et al.

[11] 4,206,563

[45] Jun. 10, 1980

[54] TRIGGER GUARD FOR TOY

[75] Inventors: Richard Baldassarre; James Graves, both of York, Pa.

[73] Assignee: McCrory Corporation, York, Pa.

[21] Appl. No.: 911,341

[22] Filed: Jun. 1, 1978

[51] Int. Cl.[2] ..... A63H 1/00; A63H 3/18

[52] U.S. Cl. ..... 46/1 E; 46/1 R; 222/79

[58] Field of Search ..... 46/1 E, 1 R; 124/31, 124/40; 222/79; 362/110, 111, 112, 113, 114; 42/69 R, 69 A, 69 B, 54, 55, 57, 58; 30/295, 323, 164, 194, 232; 2/18; 145/61 E, 61 J, 61 K, 61 H; 29/234, 235; 138/89, 96 R

[56] References Cited

U.S. PATENT DOCUMENTS

| | | | |
|---|---|---|---|
| 1,700,782 | 2/1929 | Westwood et al. | 222/79 |
| 2,589,977 | 3/1952 | Stelzer | 222/79 |
| 2,618,885 | 11/1952 | Tigrett | 46/1 E |
| 2,628,450 | 2/1953 | Shelton | 42/54 |
| 2,871,617 | 2/1959 | West | 46/1 R |
| 3,674,024 | 7/1972 | Cirillo | 222/79 |
| 3,771,207 | 11/1973 | Campbell | 30/194 |

*Primary Examiner*—Louis G. Mancene
*Assistant Examiner*—Michael J. Foycik, Jr.
*Attorney, Agent, or Firm*—Bierman & Bierman

[57] ABSTRACT

The present invention relates to a device which uses a trigger and pistol grip wherein the trigger has a gripping side adapted to receive a finger and an opening rearward of the gripping side which is substantially parallel to the grip. The trigger is covered by a guard made of a smooth material which covers the opening so that the guard contacts a portion of the hand holding the grip and urges the portion of the hand out from between the trigger and the grip.

7 Claims, 3 Drawing Figures

FIG. 1
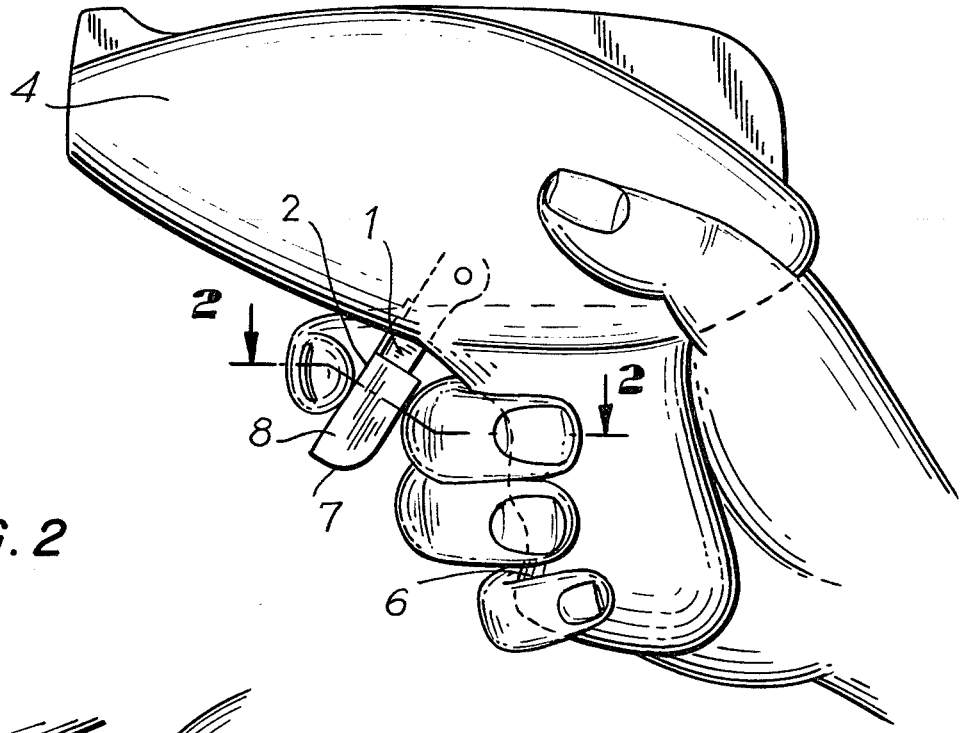
FIG. 2
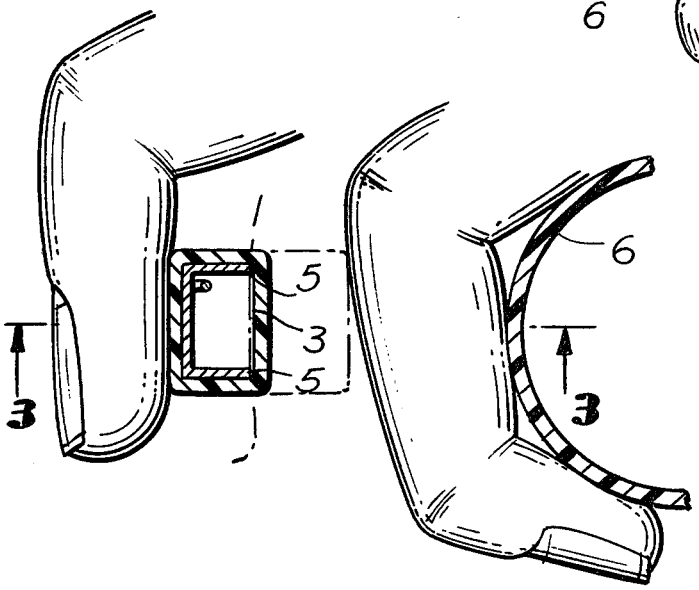
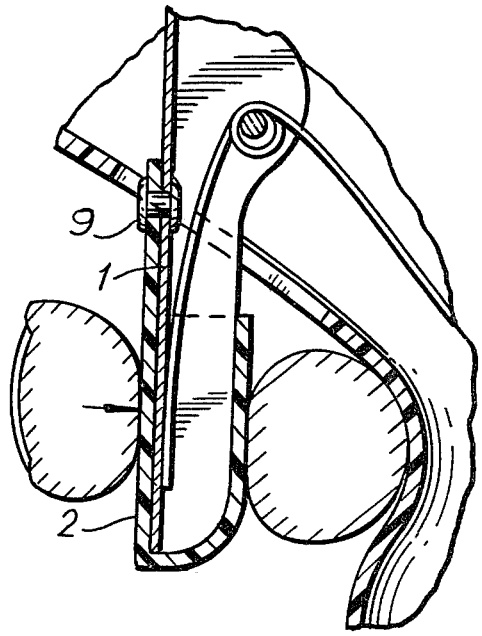
FIG. 3

TRIGGER GUARD FOR TOY

BACKGROUND OF THE INVENTION

The present invention is directed to a novel protective guard for use in any device employing a trigger and pistol grip. This guard is used to prevent pinching of the user's hand between the trigger and the pistol grip.

One of the problems in using a trigger operated device results from the pulling of the trigger inwardly toward the pistol grip. As the trigger is pulled, the distance between the trigger and the grip decreases to a point where the trigger contacts the fingers of the gripping hand. This phenomenon causes pinching which can result in serious injury to the user.

This is especially true when the trigger operated device is a toy gun used by children. Children are noted for their aggressive behavior during active periods of playing and fighting. It is not uncommon for children to push, fall and tumble with each other. During such activities, a child can suffer serious injury when the trigger is inadvertently pressed against the fingers enveloping the pistol grip.

The construction of triggers, in inexpensive toy guns having exposed edges of metal, leads itself to the cutting and pinching of the childs' delicate skin. The edges of metal contact the skin and will continue to press the skin until the pressure is released. Many times during active play, this does not occur until the skin has been severly pinched or lacerated.

Generally, it is insufficient to increase the distance between the trigger and the grip in order to prevent pinching. This method results in an increase in the length of the device and may upset the weight balance between the gripping portion and the remainder of the device.

It is likewise inadequate to alter the alignment of the trigger and pistol grip in order to prevent contact of the trigger and gripping hand. For example, if the trigger were moved to the right or left of the gripping portion, this would alleviate the the problem of pinching. However, the simultaneous pulling of the trigger and squeezing of the grip would be rendered awkward.

SUMMARY OF THE INVENTION

An object of the present invention is to maintain the distance and alignment between the trigger and pistol grip while avoiding pinching of the gripping hand by the trigger. This is accomplished by providing a trigger with a guard which covers the trigger so that the guard contacts the gripping hand when the trigger is pulled inwardly.

More specifically, when a person engages a gun or other device employing a trigger and pistol grip, the forefinger is placed over the trigger while the remainder of the hand wraps around the pistol grip. Typically, the middle finger of the hand is pinched by the trigger when it is pulled inwardly by the forefinger. Additionally, serious injury can result if sudden contact is made with the device which results in a reflex movement of the forefinger squeezing the trigger.

The present invention contemplates a guard for use in all types of devices employing a trigger and pistol grip. However, special use can be made of the present invention in toy guns used by children. These devices typically have a trigger made of an inexpensive metal. The trigger is formed by three sides of metal with an open side rearward of the side contacting the forefinger. This opening runs substantially parallel to the pistol grip. The purpose of this construction is to eliminate as much metal as possible in order to reduce the cost of production.

However, the edges of each of the sides, adjacent the side contacting the forefinger, makes contact with the gripping hand to pinch or lacerate the hand.

The present guard provides for a cover enveloping the edges and the opening to thereby form a smooth surface between the trigger and the gripping hand. The guard can be made of any suitable material which provides a smooth surface. Preferably, a plastic material can be used. It is also desirable for the material to provide a slippery surface or, in other words, a surface which allows the trigger to slide along the skin of the gripping hand as the trigger is squeezed with resulting pressure on the gripping hand.

Attachment of the guard to the trigger can be accomplished in any conventional way. For example, the guard can be laminated or riveted on the trigger. Additionally, it is possible to provide guards which merely slip over the trigger.

The present invention is easily adaptable to virtually all types of childrens' trigger-operated toys. For example, these toys include waterpistols, airguns, dart guns, sparkler guns, etc.

BRIEF DESCRIPTION OF THE PREFERRED EMBODIMENT

In the accompanying drawings, constituting a part thereof and in which like reference characters indicates like parts, FIG. 1 represents a side view.

FIG. 2 represents an enlarged cross-section along lines 2—2 of FIG. 1; and FIG. 3 represents an enlarged cross-section along lines 3—3 of FIG. 2.

These drawings, and the embodiment shown therein is for the purposes of illustration only and is not meant to limit or in anyway redefine the invention as set forth in the generic claim of the present application.

Trigger 1, having a gripping side 2 and opening 3 rearward of said gripping side, extends from the body of gun 4. Opening 3 is formed from metal edges 5 extending rearward of gripping side 2 and runs parallel to pistol grip 6. Trigger 1 has a tapered portion 7 remote from the body of gun 4. Trigger guard 8 envelops the portion of trigger 1 extending from the body of gun 4 and is permanently affixed thereto by rivet 9.

When trigger 1 is pulled inwardly by applying pressure to gripping side 2, trigger guard 8, covering opening 3 and metal edges 5, contacts the fingers of the gripping hand which are wrapped around pistol grip 6.

Trigger guard 8, held permanently in place by rivet 9, is made of a smooth, preferably slippery plastic material which causes the fingers of the gripping hand to slide downward when contact is made.

As said fingers slide downward, they contact tapered portion 7 which provides additional encouragement for said fingers to proceed in a downward direction without pinching or cutting.

What we claim is:

1. In a toy employing a depending trigger and a depending grip, said trigger substantially parallel to said grip and having a gripping side adapted to receive a finger and an opening rearwardly of said gripping side, the improvement comprising a smooth, reawardly-facing guard having a smooth surface covering said opening whereby said guard is adapted to contact a portion of the hand holding said grip when said trigger is pulled, and to urge said portion out from between said trigger and said grip.

2. A toy according to claim 1 wherein said surface is adapted to slide when brought into contact with said portion.

3. A toy according to claim 1 wherein said guard is made of smooth plastic.

4. A toy according to claim 1 wherein said trigger is mounted on said device at or adjacent one end, the other end of said trigger being remote from said device, said guard being tapered in the direction of said other end.

5. a toy according to claim 1 wherein said guard is riveted to said trigger.

6. In a toy according to claim 1 having a depending trigger and a depending grip substantially parallel thereto, said trigger having a gripping side adapted to receive a finger, said trigger being of U shaped cross section, the opening of said U shaped cross section being rearwardly of said gripping side, said trigger adapted to be moved toward said grip by the pressure of said finger, the improvement which comprises a guard on said trigger substantially covering said opening, said guard having a smooth, rearwardly facing surface and having the end remote from said device tapered, whereby said guard is adapted to contact a portion of a hand actuating said trigger when said trigger is pulled, and to urge said portion out from between said trigger and said grip.

7. In a toy having a depending trigger and a depending grip substantially parallel thereto, said trigger having a gripping side adapted to receive a finger, said trigger being of U shaped cross section, the opening of said U shaped cross section being rearwardly of said gripping side, said trigger pivotally mounted at or adjacent one end, the other end of said trigger being remote from said device, said trigger adapted for pivotal movement toward said grip under pressure of said finger, the improvement which comprises a guard on said trigger substantially covering said opening, said guard having a smooth, rearwardly facing surface and having its edges rounded and said other end tapered, whereby said guard is adapted to contact a portion of a hand actuating said trigger when said trigger is pulled, and to urge said portion out from between said trigger and said grip.

* * * * *